US006046963A

United States Patent [19]

Glenning

[11] Patent Number: 6,046,963

[45] Date of Patent: Apr. 4, 2000

[54] DEPLOYABLE HULL ARRAY SYSTEM

[75] Inventor: Daniel M. Glenning, Newport, R.I.

[73] Assignee: The United States of America as represented by the Secretary of the Navy, Washington, D.C.

[21] Appl. No.: 09/152,474

[22] Filed: Sep. 11, 1998

[51] Int. Cl.[7] ..... H04R 1/02

[52] U.S. Cl. ..... 367/188

[58] Field of Search ..... 367/188, 173, 367/153, 165; 114/321, 324, 325, 339, 340, 342; 310/337

[56] References Cited

U.S. PATENT DOCUMENTS 5,634,424 6/1997 Ortelli ..... 114/340

5,737,279 4/1998 Carter ..... 367/173

*Primary Examiner*—Daniel T. Pihulic

*Attorney, Agent, or Firm*—Michael J. McGowan; James M. Kasischke; Prithvi C. Lall

[57] ABSTRACT

The subject invention is a rigid sensor array system for an underwater vehicle having an inner hull and an outer hull. A guide means is positioned between the vehicle's inner and outer hulls, and a sensor array panel is mounted slidably on the guide means. An exit slot is formed in said outer hull allowing the sensor array panel to slide out from between the hulls to a deployed position extending from the outer hull. The guide means is provided as tracks on either side of the array panel. In a further embodiment, a drive means is provided for moving the array panel from between the hulls to its deployed position.

12 Claims, 2 Drawing Sheets

DEPLOYABLE HULL ARRAY SYSTEM

STATEMENT OF GOVERNMENT INTEREST

The intention described herein may be manufactured and used by or for the Government of the United States of America for governmental purposes without the payment of any royalties thereon or therefor.

BACKGROUND OF THE INVENTION (1). Field Of The Invention

The present invention relates to an easily deployed, rigid hull array.

(2). Description Of The Prior Art

Underwater sensors, such as hydrophones, are used to detect or receive underwater acoustic energy or signals. A sonar system, for example, uses sensors to receive underwater acoustic energy and then processes the received signals for detection, classification and localization. One advantageous way of receiving underwater acoustic energy or signals is with a large aperture underwater sensor array. One way of creating a larger aperture is by spreading various sensor elements further apart. This enhances the performance a sonar system or other similar system.

Existing sonar systems either actively receive reflected acoustic signals or passively receive acoustic signals from a source. The performance of such sonar systems is limited by the size of the receiving or sensor arrays that passively or actively receives the energy. Particularly in complex environments, such as shallow water, there is a need for a large aperture sensor array with a relatively large vertical extent.

Large aperture sensor arrays are disclosed in the prior art, but many of these devices are unsuitable for deployment from an undersea vehicle and cannot be stored between inner and outer hulls of such a vehicle.

One such array has a sinker or a float along an outer edge of the array. Force on the sinker or float acts to keep the array extended; however, dynamic forces on the array cause it to wobble when deployed. Likewise, the array cannot be extended horizontally because a buoyant force cannot support horizontal extension.

Another array comprises a plurality of telescoping structures that extend from an underwater vehicle. Sensors are deployed on the surfaces of the structures. The telescoping structures do not allow use of a wide collection surface. Accordingly, multiple telescoping structures would be necessary to provide equivalent dimensions.

None of the prior art discloses a rigid, large aperture sensor array that can be easily deployed and retracted in an underwater environment and can extend in all directions with respect to a vehicle, such as a fishing boat, submarine, torpedo, and the like.

SUMMARY OF THE INVENTION

One object of the present invention is to provide a large aperture sensor array that is easily deployed and retracted from a platform, such as a surface ship, submarine, sonobuoy, mine, spaceship, airplane, unmanned underwater vehicle, or other device.

Another object of the present invention is providing a rigid array, which can be readily stored on the platform.

Still another object of the present invention is providing a sensor array having an increased area when employed on a double-hulled underwater vehicle.

Yet another object of the present invention is to provide a plurality of retractable underwater sensor arrays that extend from a vehicle in a number of different directions.

A further object of the present invention is to provide a retractable underwater sensor array that maximizes the sensor array area while also minimizing hydrostatic drag against the sensor array created by ocean currents or motion through the water.

Accordingly, the subject invention provides a rigid sensor array system for an underwater vehicle having an inner hull and an outer hull. A guide means is positioned between the vehicle's inner and outer hulls, and a sensor array panel is mounted slidably on the guide means. An exit slot is formed in said outer hull allowing the sensor array panel to slide out from between the hulls to a deployed position extending from the outer hull. The guide means is provided as tracks on either side of the array panel. In a further embodiment, a drive means is provided for moving the array panel from between the hulls to its deployed position.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
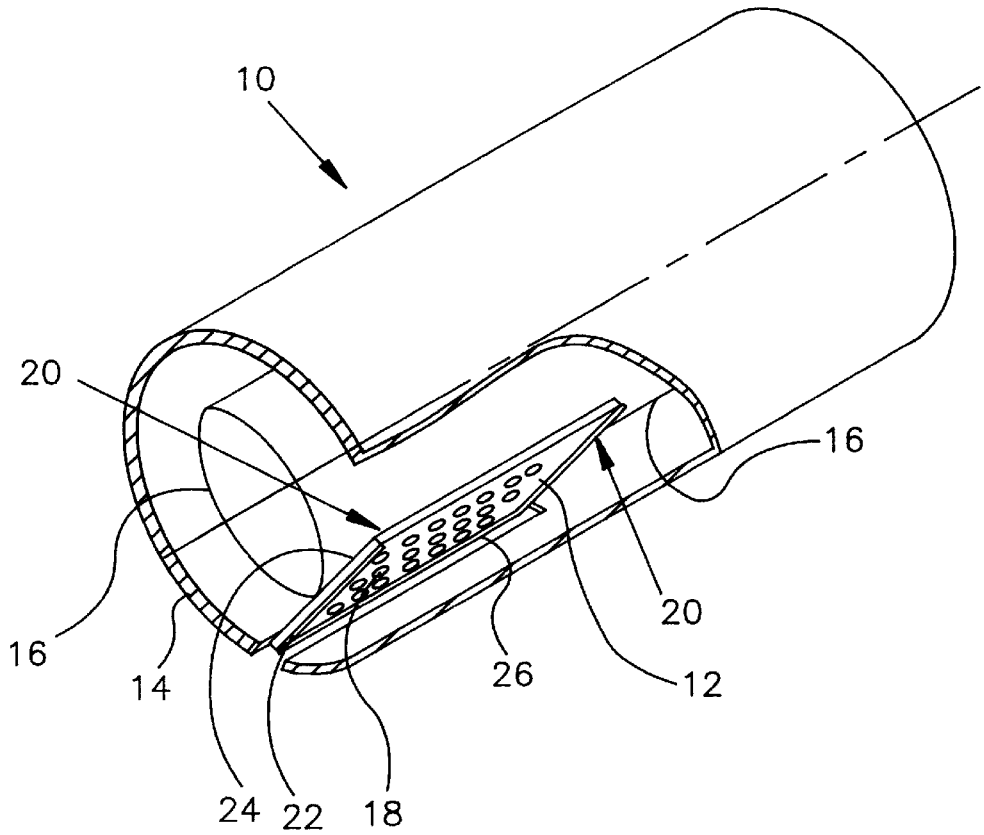
FIG. 1 is a cut-away view of a portion of an underwater vehicle having a rigid hull array retracted therein according to the present invention.

In FIG. 1, there is shown a cut-away view of an undersea vehicle 10 incorporating a hull array 12 in its stowed position. Vehicle 10 has an outer hull 14 and an inner hull 16. The area between outer hull 14 and inner hull 16 is a free flood area exposed to environmental water. An exit slot 26 is formed in outer hull 14 for deploying hull array 12. Hull array 12 is a rigid rectangle having a plurality of sensors 18 disposed thereon. Hull array 12 can be made from any rigid, corrosion resistant material such as stainless steel, aluminum or a composite material. Sensors 18 are joined to analysis circuitry within inner hull 16. These sensors 18 can be either velocity sensors or pressure sensors operating on piezoelectric, optical or magnetostrictive principles or the like. Hull array 12 is slidably mounted at each side to guide track sets 20. Each guide track set 20 has an outer track 22 and an inner track 24.

In the configuration shown the array height of the rigid hull array 12 is only limited by the difference in hull diameters. The equation governing this height is as follows:

$$h = \sqrt{D_o^2 - D_i^2} \tag{1}$$

where:

h is the height of the array 12, $D_o$ is the diameter of the outer hull 14, and $D_i$ is the diameter of the inner hull 16.

The diameters used in the above equation are outer diameter of the inner hull 16 and the inner diameter of the outer hull 14. The above equation also assumes that array 12 has no thickness. Any thickness of this array will reduce the height.

Figure 2:
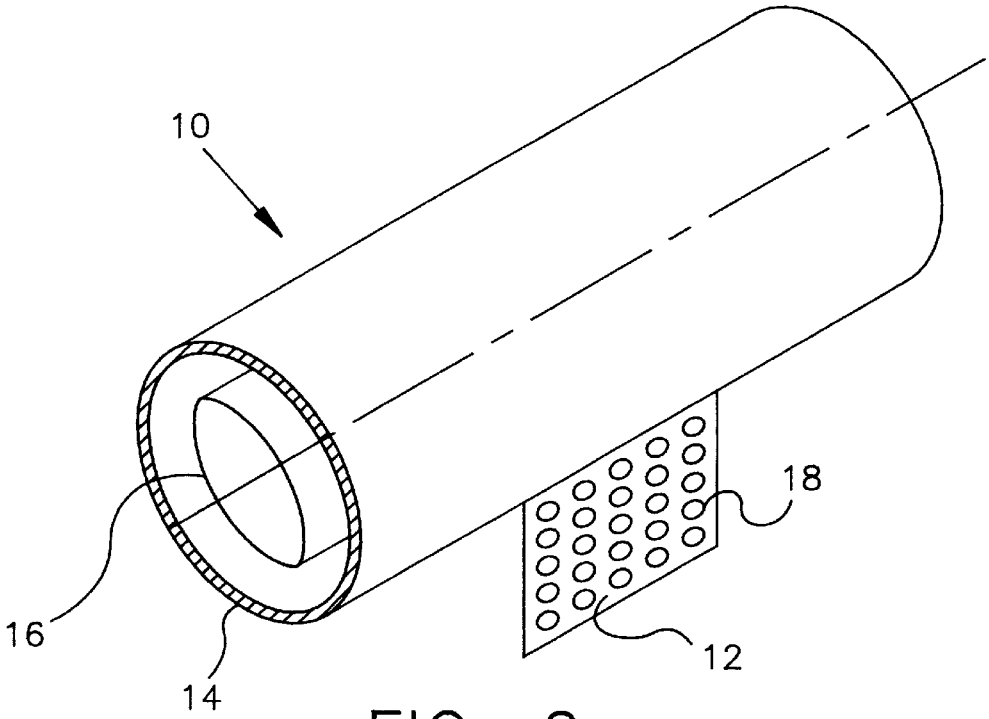
FIG. 2 is a view of a portion of an underwater vehicle having a rigid hull array deployed therefrom according to the present invention.

FIG. 2 shows undersea vehicle 10 with hull array 12 deployed. In this position, hull array 12 and sensors 18 extend out beyond outer hull 14 to increase the breadth or aperture of the hull array. Similar arrays can be deployed from the top and sides of the vehicle from stowed positions between the inner and outer hulls.

Figure 3:
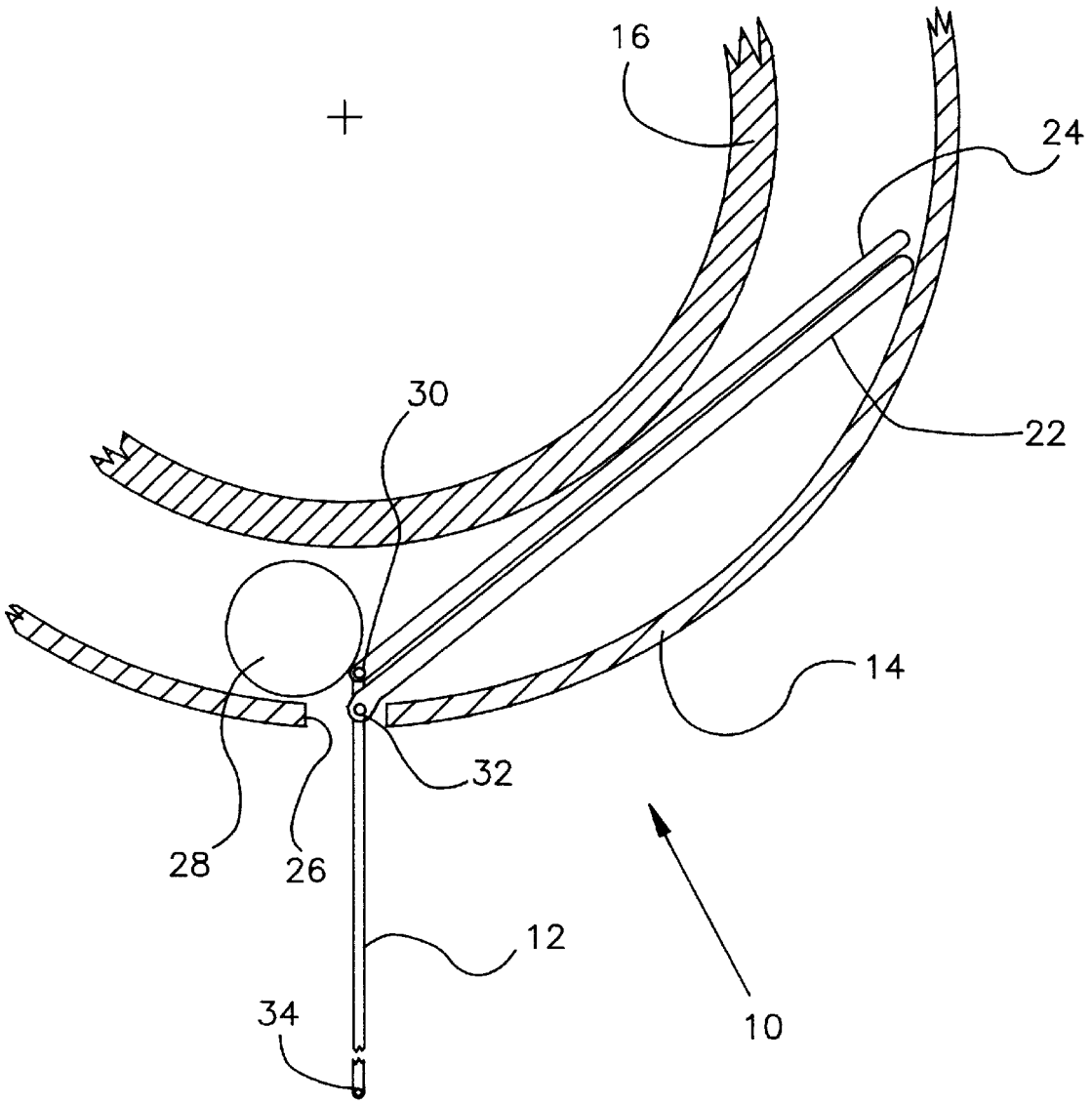
FIG. 3 is a sectional view of an underwater vehicle showing the deployment mechanism of the rigid hull array according to the present invention.

FIG. 3 provides a sectional view of undersea vehicle 10 showing details of the hull array 12 deployment system. This Figure shows outer guide track 22 and inner track 24 of one guide track set 20. Outer guide track 22 has a proximate end located between said inner and outer hulls 16, 14. A distal end of outer guide track 22 is positioned at exit slot 26. Inner guide track 24 has similar proximate and distal ends. Guide track sets 20 can be mounted to inner hull 16 or outer hull 14. At least one inner guide track 24 of the two guides track sets 20 are joined to a drive mechanism 28. Drive mechanism 28 has a motor and a chain drive disposed in inner guide track 24. Although the motor is shown at the distal end of inner guide track 24, it can also be positioned at the proximate end. Inner guide track 24 and outer guide track 22 is bent at the distal ends thereof, pivoting hull array 12 as it is deployed.

Hull array 12 has first, second and third guide pins 30, 32 and 34 positioned on the sides of array 12 to interface with guide track sets 20. First guide pin 30 extends laterally from one side of the array 12 near the array's inner edge. First guide pin 30 is positioned in inner guide track 24 where it joins the chain drive. Second guide pin 32 extends laterally from the array side close to the array's inner edge but not as close as the first guide pin 30. Second guide pin 32 is slidably disposed within outer guide track 22. Third guide pin 34 extends from the side of array 12 near the array's outer edge. Pin 34 is also slidably disposed within outer guide track 22, but it leaves the track 22 during deployment of the array 12.

During deployment, vehicle 10 activates drive mechanism 28 by causing the motor to move the chain. Chain, in turn, moves first guide pin 30 within the inner track 24. Array 12 slides out from between outer hull 14 and inner hull 16. Array 12 is retained in its position by the action of first guide pin 30 in inner track 24 and second guide pin 32 in outer track 22. The third guide pin 34 provides guidance in outer track 22 until the outer edge of array 12 leaves exit slot 26 at which time third guide pin 34 is released from track 22.

Hull array 12 slides out from between hulls 14 and 16 at an angle until it is nearly fully deployed. As array 12 reaches the end of tracks 22 and 24, outer track 22 slides second pin 32 outward. Inner track 24 retains first guide pin 30 in a straight line with a slight outward bend. The bend difference in inner track 24 and outer track 22 causes array 12 to pivot outward until it is substantially radially deployed. On retraction, these bends cause array 12 to pivot into alignment between inner and outer hulls 16 and 14.

Although this invention discloses a chain drive mechanism for deploying array 12, other mechanisms well known in the art can be used with equal facility.

In light of the above, it is therefore understood that within the scope of the appended claims, the invention may be practiced otherwise than as specifically described.

What is claimed is:

1. A rigid sensor array system for an underwater vehicle having an inner hull and an outer hull comprising:

a guide means disposed between said inner hull and said outer hull;

a sensor array panel having two sides slidably mounted on said guide means; and an exit means joined to said outer hull allowing said sensor array panel to move along said guide means from a first position in which said sensor array is between said inner and outer hull to a second position in which said sensor array panel extends from said outer hull.

2. The system of claim 1 further comprising a drive means joined to said sensor array panel for moving said sensor array panel from said first position to said second position.

3. The system of claim 2 wherein said guide means comprises:

two first guide pins positioned on either side of said sensor array panel;

two second guide pins positioned on either side of said sensor array panel;

an outer guide track positioned on each side of said sensor array panel toward said outer hull, said second guide pins sliding in said outer guide tracks; and an inner guide track positioned on each side of said sensor array panel toward said inner hull, said first guide pins sliding in said inner guide tracks.

4. The system of claim 3 wherein:

each said outer guide track having a distal end oriented toward said exit means, said outer guide track being curved at said outer guide track distal end;

each said inner guide track having a distal end oriented toward said exit means, said inner guide track being curved at said inner guide track distal end; and whereby said curved outer guide track distal end acts upon said second guide pin, and said curved inner guide track distal end acts upon said first guide pin for orienting said sensory array panel radially outward from said outer hull.

5. The system of claim 3 wherein one said first guide pin interfaces with said drive means within one said inner guide track.

6. The system of claim 5 wherein said drive means comprises:

a chain disposed in one said inner guide track having one said first guide pin joined thereto; and a motor joined to said chain.

7. An underwater vehicle comprising:

an inner hull for sealing against environmental water;

an outer hull positioned outside of said inner hull and having an exit means formed therein, said inner hull and said outer hull defining a free flood area having environmental water therein;

a guide means disposed in said free flood area; and a sensor array panel having two sides slidably mounted on said guide means, said sensor array panel moving along said guide means from a first position in which said sensor array is positioned in said free flood area to a second position in which said sensor array panel extends from said outer hull.

8. The vehicle of claim 7 further comprising a drive means joined to said sensor array panel for moving said sensor array panel from said first position to said second position.

9. The vehicle of claim 8 wherein said guide means comprises:

two first guide pins positioned on either side of said sensor array panel;

two second guide pins positioned on either side of said sensor array panel;

an outer guide track positioned on each side of said sensor array panel toward said outer hull, said second guide pins sliding in said outer guide tracks; and an inner guide track positioned on each side of said sensor array panel toward said inner hull, said first guide pins sliding in said inner guide tracks.

10. The vehicle of claim 9 wherein:

each said outer guide track having a distal end oriented toward said exit means, said outer guide track being curved at said outer guide track distal end;

each said inner guide track having a distal end oriented toward said exit means, said inner guide track being curved at said inner guide track distal end; and whereby said curved outer guide track distal end acts upon said second guide pin, and said curved inner guide track distal end acts upon said first guide pin for orienting said sensory array panel radially outward from said outer hull.

11. The system of claim 9 wherein one said first guide pin interfaces with said drive means within one said inner guide track.

12. The system of claim 11 wherein said drive means comprises:

a chain disposed in one said inner guide track having one said first guide pin joined thereto; and a motor joined to said chain.

* * * * *